US006491084B2

(12) United States Patent
Voss et al.

(10) Patent No.: US 6,491,084 B2
(45) Date of Patent: Dec. 10, 2002

(54) BOTTOM RAIL WEIGHT AND BALANCING SYSTEM

(75) Inventors: Robert J. Voss, Fountain Valley, CA (US); Kelly L. Murphy, Jamestown, NC (US); Otto Kuhar, Garfield, NJ (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 09/808,064

(22) Filed: Mar. 14, 2001

(65) Prior Publication Data

US 2002/0011314 A1 Jan. 31, 2002

Related U.S. Application Data

(63) Continuation of application No. 09/229,111, filed on Jan. 12, 1999, now Pat. No. 6,412,537.

(51) Int. Cl.[7] ..... A47H 5/00
(52) U.S. Cl. ..... 160/84.05; 160/173 R
(58) Field of Search ..... 160/84.05, 84.04, 160/170 R, 171 R, 405, 192, 191, 173 R, 178.1 R

(56) References Cited

U.S. PATENT DOCUMENTS

| | | | | |
|---|---|---|---|---|
| 13,251 | A | 7/1855 | Bixler | |
| 322,732 | A | 7/1885 | Lang | |
| 842,401 | A | 1/1907 | Goodill | |
| 927,090 | A | 7/1909 | Anderson | |
| 948,239 | A | 2/1910 | McManus | |
| 1,636,601 | A | 7/1927 | Givens | |
| 1,721,501 | A | 7/1929 | McKee | |
| 1,731,124 | A | 10/1929 | Carper | |
| 1,789,655 | A | 1/1931 | Iwata | |
| 1,951,659 | A | 3/1934 | Kesner | 156/17 |
| 2,037,393 | A | 4/1936 | Roberts | 156/17 |
| 2,049,518 | A | 8/1936 | Schier | 156/16 |
| 2,110,983 | A | 3/1938 | Carver | 156/16 |
| 2,175,549 | A | 10/1939 | Nardulli et al. | 156/17 |
| 2,250,106 | A | 7/1941 | Lorentzen | 156/17 |
| 2,260,101 | A | 10/1941 | De Falco | 156/16 |
| 2,266,160 | A | 12/1941 | Burns | 156/17 |
| 2,276,716 | A | 3/1942 | Cardona | 156/17 |
| 2,324,536 | A | 7/1943 | Pratt | 160/172 |
| 2,325,992 | A | 8/1943 | Wirthman | 160/29 |
| 2,350,094 | A | 5/1944 | Butts | 160/114 |

(List continued on next page.)

FOREIGN PATENT DOCUMENTS

| | | |
|---|---|---|
| DE | 40 03 218 A1 | 8/1991 |
| GB | 13798 | 7/1983 |
| GB | 2 262 324 A | 6/1993 |

OTHER PUBLICATIONS

"The Theory and Design of Long–Deflection Constant –Force Spring Elements", by F.A. Votta Jr., Lansdale, PA (12 pages).

U.S. Patent application 09/450,109 filed on Nov. 29, 1999 and listing Zazu Ciuca, Patrick Woods, Roger Palmer, Brian Ruggels, and Otto Kuhar as inventors (31 pages).

*Primary Examiner*—David M. Pufol
(74) *Attorney, Agent, or Firm*—Marshall, Gerstein & Borun

(57) ABSTRACT

A system for adding weight to and/or balancing the bottom rail of a window covering includes one or more body members positioned within the bottom rail, and each body member having a plurality of sockets for receiving weights. In the most preferred form of the invention, the sockets are horse-shoe shaped are adapted to receive elongate rods having a circular cross-section. The plurality of sockets in the most preferred embodiment include sockets located adjacent the front of the bottom rail when the body member is in place and other sockets arranged toward the rear. Weighting and balancing is achieved by placing one or more rods in selected ones of the sockets.

25 Claims, 2 Drawing Sheets

U.S. PATENT DOCUMENTS 2,390,826 A 12/1945 Cohn ..... 160/170
2,410,549 A 11/1946 Olson ..... 160/34
2,420,301 A 5/1947 Cusumano ..... 160/34
2,509,033 A 5/1950 Carver ..... 160/84
2,520,629 A 8/1950 Esposito ..... 160/171
2,535,751 A 12/1950 Nardulli ..... 160/170
2,598,887 A 6/1952 Burns ..... 160/170
2,609,193 A 9/1952 Foster ..... 267/1
2,687,769 A 8/1954 Gershuny ..... 160/170
2,824,608 A 2/1958 Etten ..... 160/170
2,874,612 A 2/1959 Luboshez ..... 88/60
3,141,497 A 7/1964 Griesser ..... 160/170
3,194,343 A 7/1965 Sindlinger ..... 185/10
3,358,612 A 12/1967 Bleuer ..... 104/173
3,371,700 A 3/1968 Romano ..... 160/84
3,485,285 A 12/1969 Anderle ..... 160/168
3,487,875 A 1/1970 Shukat et al. ..... 160/84
3,756,585 A 9/1973 Mihalcheon ..... 267/156
3,817,309 A 6/1974 Takazawa ..... 160/84
4,157,108 A 6/1979 Donofrio ..... 160/263
4,205,816 A 6/1980 Yu ..... 248/266
4,223,714 A 9/1980 Weinreich et al. ..... 160/309
4,326,577 A 4/1982 Tse ..... 160/259
4,344,474 A 8/1982 Berman ..... 160/121 R
4,398,585 A 8/1983 Marlow ..... 160/23 R
4,487,243 A 12/1984 Debs ..... 160/168 R
4,574,864 A 3/1986 Tse ..... 160/259
4,610,292 A 9/1986 Hausmann et al. ..... 160/120
4,623,012 A 11/1986 Rude et al. ..... 160/243
4,625,786 A 12/1986 Carter et al. ..... 160/84 R
4,631,217 A 12/1986 Anderson ..... 428/118
4,647,488 A 3/1987 Schnebly et al. ..... 428/116
4,726,410 A 2/1988 Fresh ..... 160/84 R
4,852,627 A 8/1989 Peterson et al. ..... 160/84.1
4,856,574 A 8/1989 Minami et al. ..... 160/168.1
4,862,941 A 9/1989 Colson ..... 160/84.1
4,877,075 A 10/1989 Markowitz ..... 160/84.1
4,880,045 A 11/1989 Stahler ..... 160/84.1
4,886,102 A 12/1989 Debs ..... 160/177
4,955,421 A 9/1990 Torti ..... 160/243
4,984,617 A 1/1991 Corey ..... 160/84.1
5,054,162 A 10/1991 Rogers ..... 16/198
5,067,541 A 11/1991 Coslett ..... 160/84.1
5,083,598 A 1/1992 Schon ..... 160/84.1
5,103,888 A 4/1992 Nakamura ..... 160/171
5,105,867 A 4/1992 Coslett ..... 160/84.1
5,127,458 A * 7/1992 Schaefer et al. ..... 160/168.1 R
5,133,399 A 7/1992 Hiller et al. ..... 160/171
5,141,041 A 8/1992 Katz et al. ..... 160/84.1
5,157,808 A 10/1992 Sterner, Jr. ..... 16/197
5,170,830 A 12/1992 Coslett ..... 160/84.1
5,184,660 A 2/1993 Jelic ..... 160/171
5,228,491 A 7/1993 Rude et al. ..... 160/171
5,274,357 A 12/1993 Riordan ..... 340/550
5,285,838 A * 2/1994 Rapp et al. ..... 160/168.1 R
5,313,998 A 5/1994 Colson et al. ..... 160/84.1 D
5,318,090 A 6/1994 Chen ..... 160/171
5,320,154 A 6/1994 Colson et al. ..... 160/121.1
5,363,898 A 11/1994 Sprague ..... 160/98
5,391,967 A 2/1995 Domel et al. ..... 318/254
5,413,161 A 5/1995 Corazzinni ..... 160/7
5,482,100 A 1/1996 Kuhar ..... 160/170
5,485,875 A 1/1996 Genova ..... 160/168.1
5,531,257 A 7/1996 Kuhar ..... 160/168.1
5,655,590 A * 8/1997 Bryant ..... 160/168.1 R
5,706,876 A 1/1998 Lysyj ..... 160/84.05
5,855,235 A 1/1999 Colson et al. ..... 160/121.1
6,003,584 A 12/1999 Weinreich ..... 160/191
6,009,931 A 1/2000 Peterson ..... 160/168.1 R
6,012,506 A 1/2000 Wang et al. ..... 160/170
6,024,154 A 2/2000 Wang et al. ..... 160/170
6,029,734 A 2/2000 Wang et al. ..... 160/170 R
6,056,036 A 5/2000 Todd et al.
6,079,471 A 6/2000 Kuhar
6,095,222 A 8/2000 Voss ..... 160/84.05
6,135,189 A 10/2000 Weinreich
6,149,094 A 11/2000 Martin et al.
6,234,236 B1 6/2001 Kuhar
6,283,192 B1 * 9/2001 Toti ..... 160/170 R
6,289,965 B1 * 9/2001 Ruggles ..... 160/84.04 X
6,293,329 B1 * 9/2001 Toti ..... 160/168.1 R
6,330,899 B1 * 12/2001 Ciuca et al. ..... 160/192 X

* cited by examiner

BOTTOM RAIL WEIGHT AND BALANCING SYSTEM

CROSS-REFERENCES TO RELATED APPLICATIONS, IF ANY

"This is a continuation of U.S. patent application Ser. No. 09/229,111 filed Jan. 12, 1999 now U.S. Pat. No. 6,412,537."

BACKGROUND OF THE INVENTION

1. Field of the Invention

The present invention relates generally to the art of window coverings, and more particularly to the types of window coverings which include a bottom rail, such as horizontal blinds, pleated blinds, cellular blinds, certain Roman shade products, light control window coverings and the like. In its most preferred form, the present invention relates to a system for adding weight to and/or balancing the bottom rail, so that it remains in a horizontal orientation when lowered and so that the front edge of the bottom rail and the rear edge of the bottom rail lie in an orientation desirable from an aesthetic and product utilization standpoint.

2. Description of the Prior Art

A wide variety of different types of window coverings are known which include a bottom rail. Familiar examples include horizontal venetian-type blinds, sometimes referred to as mini-blinds, although the slats may be quite large, pleated shade window coverings, cellular window coverings, various light control products and certain Roman shade products. Typically, such window coverings include a head rail to be mounted at the top of a window, window covering material coupled to or rolled up within the head rail and a bottom rail coupled to the lower end of the window covering material. With venetian-type blinds, a ladder system is employed to suspend a plurality of slats in a horizontal orientation between the head rail and bottom rail, and two or more lift cords are located between the ends of the slats and are passed through each slat from the bottom rail to the top rail. Typically the lift cord passes through holes in each slat, although other systems are known in the art. Most frequently, the lift cords are directed using pulleys or other mechanisms in the head rail to one end of the head rail, at which point they descend along one side edge of the window covering so that they can be manipulated by the user. By pulling on the lift cords, the bottom rail is moved toward the top rail, with corresponding accumulation of slats on the bottom rail as the upward movement continues.

Similar lift cord systems are used in a variety of the "soft" window products which are currently popular, including window coverings which have pleated fabric between the head rail and the bottom rail, window coverings which have cellular fabric material between the head rail and the bottom rail, light control products which include cells having opaque portions arranged between the bottom rail and a roller within the head rail, and the like.

Systems are also known wherein the lift cords may accumulate on spring motor reels within the head rail so that they do not exit the head rail at all. Such a system is shown in U.S. Pat. No. 5,482,100 issued Jan. 9, 1996 to Kuhar entitled "Cordless, Balanced Venetian Blind Or Shade With Consistent Variable Force Spring Motor". This system uses spring motors to balance the weight of the bottom rail and the accumulating window covering material as the window covering is raised or lowered by simply grasping the bottom rail and urging it upwardly or downwardly.

A problem common to such window coverings is balancing of the bottom rail and in some cases adding sufficient weight to the bottom rail to have it hang properly or lower smoothly. Due to various manufacturing considerations, such as the location and placement of the lift cords, the ways in which the ladders or window covering material are attached to the bottom rail, and the characteristics of the window covering material itself, there may be a need to provide weight in the bottom rail at various locations from end to end or various locations from front to back. Such problems are most pronounced in window coverings of the "soft" variety in which the head rail itself may be of a lighter gauge material due to the delicate nature of the window covering material.

Several solutions to the weight distribution problem have been proposed. The simplest is the use of weighted, tape-like strips which are adhered to the bottom rail by the fabricator at appropriate locations. Most frequently, such strips are applied after the window covering has been fabricated and after it has been determined where any imbalance may exist.

Another suggestion for resolving the weight balance issue is that proposed in U.S. Pat. No. 5,320,154 issued Jun. 14, 1994 to Colson, et al. and entitled "Method and Apparatus For Mounting A Retractable Window Covering". In the disclosed device, a weight element is slidably disposed in the bottom rail and is moved longitudinally along the bottom rail until appropriate balance is achieved.

While both of these known systems provide control over the imbalance issues discussed above, they suffer from one or more drawbacks with regard to installation and/or use. For example, with fabric window coverings, the balance may change after the window covering has been used, for example if the pleats in cellular or pleated shades hang out for extended periods of time after initial manufacture. In such cases, it may be necessary to dismantle the bottom rail and readjust the weight and balancing system, a process which may be difficult when using a tape system or a sliding system, depending on the skill of the owner or user of the window covering.

A weight and balancing system which would be readily adaptable to a wide variety of window coverings and which would be easily understood and used by consumers would represent a significant advance in this art.

FEATURES AND SUMMARY OF THE INVENTION

The present invention features a bottom rail weight and balancing system which is widely adaptable to different types of window coverings and which is inexpensive, easy to install and easy to adjust.

The present invention also features a bottom rail weight and balancing system which may be adjusted by an untrained consumer after a window covering has been installed.

A different feature of the present invention is to provide a weight and balancing system which may be used for a variety of sizes of window coverings and which may be manufactured in different configurations to permit different incremental adjustments to enhance the accuracy of the balance desired for aesthetic and operational purposes.

How these and other features of the present invention are accomplished will be described in the following detailed description of the preferred embodiment, taken with the FIGURES. Generally, however, they are accomplished by providing one or more body members which are inserted into the bottom rail and may be disposed along the bottom rail at a location selected by the individual responsible for weighting and/or balancing same. The body members include a plurality of sockets adapted to receive weights, the sockets being arranged from front to rear. Weights are inserted into selected ones of the sockets to accomplish the appropriate weighting and/or balancing. The features are accomplished in the most preferred form of the invention by using body members having a plurality of horse-shoe shaped sockets adapted to receive weights which are round in cross-section. The preferred weights are elongate rods which are snapped into the sockets. The number of rods used, and the particular sockets employed, are varied to accomplish the desired weighting and/or balancing objectives. The body members may also be used as part of the mechanism for attaching the window covering material to the bottom rail. Other ways in which the features of the invention are accomplished will become apparent to those skilled in the art after they have read the present specification. Such other ways are deemed to fall within the scope of the present invention if they fall within the scope of the claims which follow.

DESCRIPTION OF THE DRAWINGS

In the following drawings, like reference numerals are used to denote like components.

DETAILED DESCRIPTION OF THE PREFERRED EMBODIMENT

Before proceeding to the detailed description of the preferred embodiment, several general comments are warranted about the applicability and the scope of the present invention.

First, the bottom rail weight and balance system of the present invention can be employed to add weight to the bottom rail and/or to balance the bottom rail of any of the window covering systems described above and other window covering systems known to the art. It is illustrated in connection with a cellular window covering, but such illustration is for exemplary purposes only.

Second, the number of body members and weights used in a particular window covering may vary depending upon the amount of weight adjustment which is necessary to achieve proper weighting and/or balancing and, among other things, the length of the bottom rail and the need to provide weight separate and apart from balancing the system. In the illustrated embodiment, two body members are employed and are spaced evenly from the outer ends of the bottom rail.

Third, the number of individual sockets in each body member can also vary. In the illustrated embodiment, four sockets are provided which permits a large number of adjustment capabilities using from one to four rod-shaped weights. For more accurate balancing in delicate systems, a larger number of sockets might be employed with lighter and smaller weights, while for larger systems, either a larger or smaller number of sockets might be employed with larger weights.

Fourth, the preferred and illustrated socket and weight configuration includes sockets having a generally horse-shoe shaped cross-section and elongate rods which are received therein by snapping them through the opening of the horse-shoe into a generally circular base portion. The particular shape of the socket and the cross-section of the weight material can also be widely varied by those skilled in the art after they have read and understand the present invention.

Fifth, the particular materials of construction can vary, polypropylene or other plastic materials being preferred for the body member and steel or other metal or metal alloys being preferred for the weights. Several factors affecting the material selection include the particular end use application and material cost.

Sixth, the way in which the body members are inserted into the head rails can be variously embodied. They may be designed to slip in from either end during fabrication or they may be placed into the bottom rail through the upper opening therein while under compression or by slipping them between the rail flanges and tilting them as will become apparent when the FIGURES are explained. Furthermore, as illustrated, the body members are a part of the window covering attachment system to the bottom rail, but that aspect may be accomplished in a variety of other ways known to the art.

Finally, the length of the weight elements themselves can be varied, again depending primarily on the overall size of the system.

Figure 1:
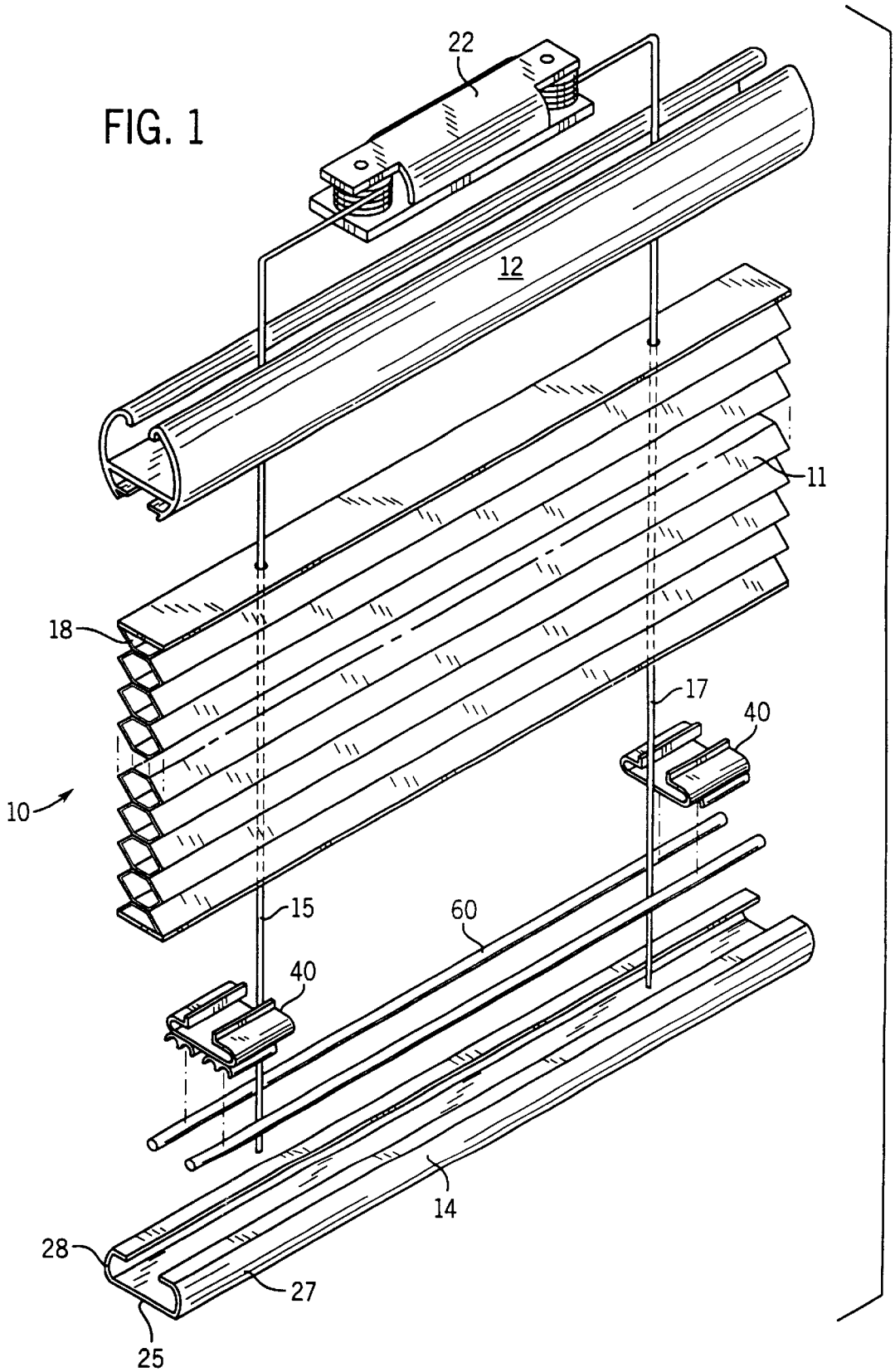
FIG. 1 is an exploded view of the lower portion of a window covering illustrating the covering material, the bottom rail, the body member with sockets and the weights employed in the most preferred form of the present invention.

Proceeding now to a description of FIG. 1, a portion of a window covering 10 is shown to include cellular window covering material 11, a head rail 12 and a bottom rail 14. Many details of these components are not provided, because in and of themselves they do not form part of the present invention. Lift cords 15 and 17 are schematically illustrated, and pass through the various cells 18 of window covering material 11 and into each of rails 12 and 14. In this FIGURE, the cords 15 and 17 are schematically shown as being coupled to a spring motor 22 of the type described in the aforementioned Kuhar patent. At their lower ends, they are attached to structure (not shown) in the bottom rail which may be any structure known to the art. During fabrication, the length of the cords 15 and 17 is typically adjusted and fixed so that when fully lowered, the bottom rail 14 and head rail 12 will be separated by a predetermined distance, e.g. the height of a window.

Any technique known in the art may be employed for coupling the material 11 to the rails 12 and 14. As an example, and not by way of limitation, cellular material 11 can be attached to each rail by placing a cell 18 at the top of the window covering material inside the head rail 12 and inserting a rigid slat into that cell. If the head rail 12 has a slot in its bottom surface narrower than the slat, the cell will be captured within head rail 12. A similar coupling technique is illustrated to attach the bottom cell to bottom rail 14. Since bottom rail 14 has a slot in its upper surface which is narrower than the slat 19 inserted into the bottom cell, the bottom of the material 11 will be captured within rail 14 (see FIG. 3).

Additional details will now be provided for the illustrated bottom rail 14. The shape for the bottom rail can be selected from those known to the art, and since the bottom rail is visible during use, aesthetics may be very important. However, a simple bottom rail design will be utilized for purposes of this description, as the body members to be employed therewith can be variously configured to match whatever bottom rail design is selected. In the preferred embodiment, the bottom rail includes a generally flat bottom portion 25 extending the entire width of the window covering 10 and is bounded on the front and back by C-shaped edges 27 and 28. The depth of the edges 27–28 is sufficient to allow containment of those elements of window covering 10 which are normally captured in the bottom rial, including the body members and weights to be described later in this description as well as the bottom cell of material 11 and a slat 19. Moreover, the C-shaped edges 27–28 create a slot 30 (see FIG. 3) which is narrower than the overall width of bottom rail 14. One function of such slot is the containment of slat 19, but another can be to hold the body members in place in connection with the illustrated and preferred weighting and/or balancing system.

Most bottom rails in use today are made from steel or aluminum and are painted an appropriate color for the window covering. Vinyl materials may also be employed and are in common use for lower priced point applications.

Figure 2:
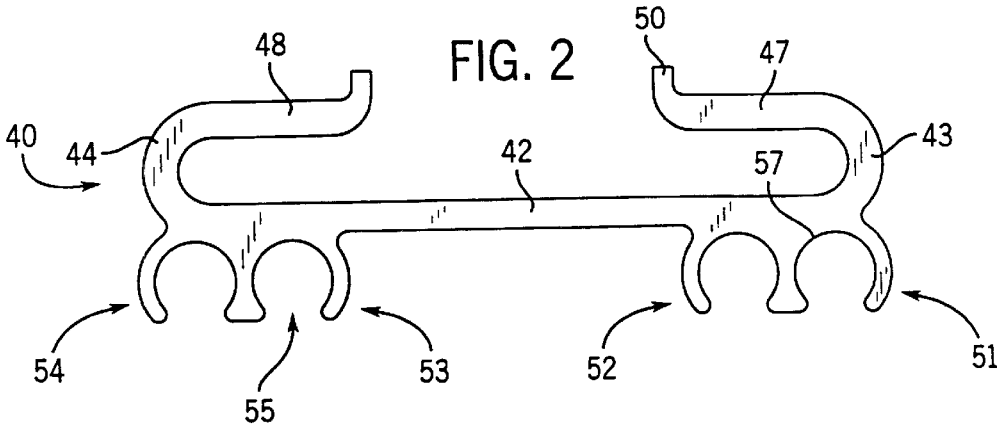
FIG. 2 is an end view of the body member shown in FIG. 1.

Proceeding next to a description of the body members 40 used in the preferred embodiment of the invention, reference be made to FIG. 2. The end view shows that body member 40 includes a flat bottom 42 and a pair of C-shaped edges 43 and 44 adapted to slidingly fit with the interior of edges 27 and 28 of the bottom rail 14. Body members 40 can thus be placed within bottom rail 14 and be retained in the desired position by the fabricator or the user of the window covering. The preferred body member 40 includes short extensions 47 and 48 which are parallel to bottom 42, each terminating in an upturned flange 50. The space between extensions 47 and 48 is sufficient to capture the bottom cell of material 11 and slat 19 and, preferably, the tips 50 lie adjacent to but inwardly of the edges of slot 30 provided in bottom rail 14.

In the illustrated embodiment, body member 40 also includes four generally horseshoe-shaped and downwardly extending sockets 51, 52, 53 and 54. They extend along the entire length of the body members, and sockets 51 and 52 are arranged generally toward the front of the body member and beneath extension 47, while sockets 53 and 54 extend along the rear and below extension 48. This arrangement is preferred, but the sockets can be equally spaced. In the preferred embodiment, the body member and sockets are made as a unitary plastic molding using polypropylene, but different materials could be used, and the sockets could be attached using adhesives, heat fusion and any other known fastening technique.

Figure 3:
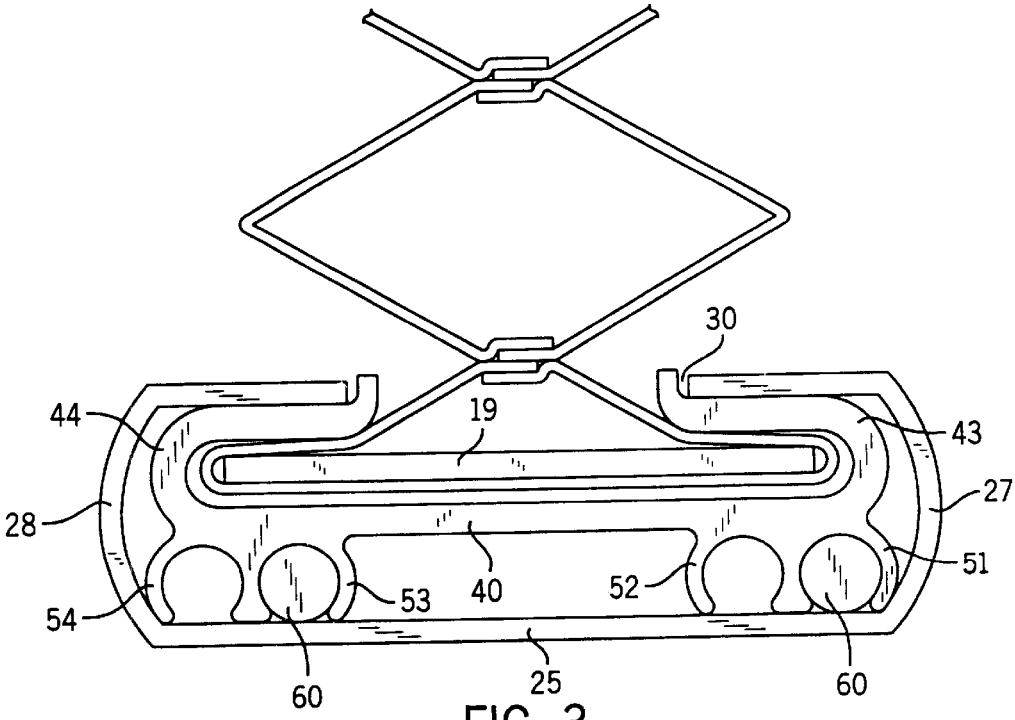
FIG. 3 is an end view of a body member, bottom rail and two rod weights used in the most preferred form of the present invention.

Each of sockets 51–54 includes a somewhat constricted opening 55 (see socket 53) and a generally circular base portion 57 (see socket 51). Base portion 57 adjoins bottom portion 42 of the body member and the openings 55 is preferably arranged laterally of bottom portion 42 so that weight members may be snapped into the sockets 51–54 by pushing upwardly, spreading the openings 55 slightly and having the weights come to rest within the circular base portions 57. By reference to FIG. 1, it will be noted that the preferred weight members are elongate, cylindrical rods 60, two of which are shown in the FIGURES. Rods 60 are shown in FIG. 3 disposed in sockets 51 and 53, which, as will be readily appreciated, is only one of numerous arrangements for weighting and balancing the bottom rail once a pair of body members are disposed therein and spaced apart from one another. The illustration of FIG. 1 shows two body members 40, two rods 60 and the body members being disposed adjacent to but spaced apart from the opposite ends of bottom rail 14. Rods 60 are of a length sufficient to be captured within the sockets of the two body members 40. It will be readily appreciated, however, that more than two body members 60 can be used and that the length of the rods could be adjusted depending on the specification of the particular window covering. For example, for very wide window coverings, two pairs of body members, each with their own set of rods could be employed, or alternatively, three or more body members could be spaced along the bottom rail 14, with rods 16 being long enough to be joined to the three or more body members.

The selection of the materials for rods 60, as previously indicated, can be variously embodied. They should be selected, from a diameter standpoint, so that they snap into and are securely held within the sockets when pushed upwardly against and through the openings 55.

To illustrate the wide variety of combinations which are possible using the present invention, one rod might be used and it could be placed at any of the locations shown for the sockets 51–54, to thereby provide a small amount of weight for the bottom rail and balance the bottom rail appropriately between front to back. The other extreme would be the use of four rods which might be used for the single purpose of adding weight to the bottom rail, wherein the weight distribution is even between the front and the back. If two rods 60 were to be employed, they could be arranged in a variety of different socket combinations including, sockets 51/52, 51/54, 52/53, 52/54, 53/54 as well as the illustrated 51/53 combination. When three rods are used they may also be arranged in adjacent sockets such as 51/52/53 or spaced socket configurations, such as 51/53/54. Other combinations are obviously possible using three rods 60.

As mentioned before, since the number of rods and the number of sockets and the arrangement of the sockets along the bottom of body member 40 can be variously arranged, one of nearly an infinite number of combinations could be selected for a particular type of window coverings once their weighting and/or balancing requirements have been generally noted.

While certain preferred and illustrated embodiments have been either shown in the drawings and/or described in the accompanying description, the invention is not to be limited by these examples but is to be limited solely by the claims which follow.

What is claimed is:

1. A method of balancing a window covering of the type that includes a top mounting, a bottom rail, a window covering material disposed therebetween, a spring motor assembly, lift cords coupling the spring motor assembly to the bottom rail, and a balancing system adapted to ensure that the bottom rail remains at any position selected by the operator of the window covering including a fully raised position in which the bottom rail is near the top mounting, a fully lowered position in which the bottom rail is spaced from the top mounting and all positions therebetween, the method comprising:

determining the amount of weight required to ensure that the bottom rail remains at any of said positions selected by the operator of the window covering; and coupling at least one member having the required amount of weight to the bottom rail.

2. The method of claim 1, wherein coupling the at least one member includes coupling the at least one member to a body member having at least one socket.

3. The method of claim 2, further providing the at least one socket with an elongate channel having a generally horseshoe-shaped opening.

4. The method of claim 2, further coupling a portion of the window covering material to an upwardly facing channel opposite the sockets.

5. The method of claim 2, further providing two or more sockets in the body member.

6. The method of claim 2, further including providing at least two body members.

7. The method of claim 1, wherein the at least one member is a cylindrical rod.

8. The method of claim 1, wherein coupling the at least one member to the bottom rail includes coupling the at least one member at equally spaced positions relative to each end of the bottom rail.

9. The method of claim 1, wherein coupling the at least one member to the bottom rail includes coupling the at least one member at equally spaced positions relative to a front and rear of the bottom rail.

10. A method of inhibiting the movement of a window covering that includes a window covering material, a bottom member at least partially supporting a varying amount of the window covering material thereon during raising and lowering of the bottom member, and lift members operatively connected to the bottom member for raising and lowering the bottom member, the method comprising the steps of:

applying a first force to the lift members in a direction substantially opposite the direction of gravity, thereby tending to raise the bottom member;

adding at least one weighted member to the bottom member sufficient to balance the first force and the force of gravity operating on the window covering material and the bottom member to inhibit movement of the bottom member.

11. The method of claim 10, wherein applying the first force includes applying the first force by a spring motor.

12. The method of claim 11, further including operatively connecting the lift members to the spring motor.

13. The method of claim 12, wherein adding the at least one weighted member to the bottom member includes adding the at least one weighted member at equally spaced positions relative to each end of the bottom member.

14. The method of claim 12, wherein adding the at least one weighted member to the bottom member includes adding the at least one weighted member at equally spaced positions relative to a front and rear of the bottom member.

15. The method of claim 12, wherein adding at least one weighted member includes adding the at least one weighted member to a body member having at least one socket.

16. The method of claim 15, further providing the at least one socket with an elongate channel having a generally horseshoe-shaped opening.

17. The method of claim 16, wherein the at least one weighted member is a cylindrical rod.

18. A method of balancing a window covering of the type including a top mounting, a bottom rail having a predetermined weight, a window covering material disposed between and operatively attached to the top mounting and the bottom rail, a spring motor assembly having a predetermined spring force, and lift cords extending between and connecting the top mounting and bottom rail, and operatively coupled to the spring motor assembly, the method comprising the steps of:

adjusting the weight of the bottom rail by adding or removing sufficient weight to the bottom rail to counterbalance the predetermined spring force of the spring motor assembly so as to retain the bottom rail at any position relative to the top mounting as the bottom rail is vertically adjusted relative to the top mounting.

19. The method of claim 18, wherein adding or removing sufficient weight includes adding or removing at least one member to or from the bottom rail at equally spaced positions relative to each end of the bottom rail.

20. The method of claim 18, wherein adding or removing sufficient weight includes includes adding or removing at least one member to or from the bottom rail at equally spaced positions relative to a front and rear of the bottom rail.

21. The method of claim 17, wherein adding or removing sufficient weight includes coupling at least one member to a body member having at least one socket.

22. The method of claim 21, further including at least two body members.

23. The method of claim 21, further providing the at least one socket with an elongate channel having a generally horseshoe-shaped opening.

24. The method of claim 23, wherein the at least one member is a cylindrical rod.

25. The method of claim 18, wherein the at least one member is adhesively attached to the bottom rail.

* * * * *

UNITED STATES PATENT AND TRADEMARK OFFICE

CERTIFICATE OF CORRECTION

PATENT NO. : 6,491,084 B2
DATED : December 10, 2002
INVENTOR(S) : Robert J. Voss et al.

It is certified that error appears in the above-identified patent and that said Letters Patent is hereby corrected as shown below:

Column 8,
Line 27, please delete “includes includes” and insert -- includes --.

Signed and Sealed this

Fourteenth Day of October, 2003

JAMES E. ROGAN
*Director of the United States Patent and Trademark Office*